US005685516A

United States Patent [19]

Simmons

[11] Patent Number: 5,685,516

[45] Date of Patent: Nov. 11, 1997

[54] WALL HANGER

[76] Inventor: Michael Simmons, 2668 Wanda Ave., Simi Valley, Calif. 93065

[21] Appl. No.: 588,433

[22] Filed: Jan. 18, 1996

[51] Int. Cl.[6] ..... A47G 1/16

[52] U.S. Cl. ..... 248/489; 248/498; 40/757

[58] Field of Search ..... 248/489, 547, 248/549, 497, 498, 490, 493, 488, 475.1; 40/757, 759, 761

[56] References Cited

U.S. PATENT DOCUMENTS

| | | | |
|---|---|---|---|
| 3,552,708 | 1/1971 | Hillstrom | 248/498 |
| 4,356,648 | 11/1982 | Beaalieu | 40/757 |
| 4,391,053 | 7/1983 | Anthony | 40/757 |

*Primary Examiner*—Ramon O. Ramirez
*Assistant Examiner*—Willie Berry, Jr.
*Attorney, Agent, or Firm*—John Lezdey

[57] ABSTRACT

A wall hanger is disclosed for securing an object having a suspension element to a surface. In its basic embodiment, the wall hanger comprises a first and second portion and restrictive mechanism. The first portion has opposing first and second sides, a top and bottom, and a first bore substantially normal to the sides which is adapted to receive the shaft of a fastener. About the first bore on the second side is an annular seating region to accommodate the head of the fastener such that the head of the fastener presses against the seating region when the first portion is in a mounted position. The second portion has opposing third and fourth sides, a top and bottom, and a second bore larger than the head of the fastener such that the fastener passes through it. The first and second portions are contiguous at the bottom when in the mounted position such that the second side faces the third side to define an intermediate region. The intermediate region is adapted to accommodate the suspension element of the object. When in the mounted position, the first and second bores align such that the second bore provides access to the first bore. The restrictive mechanism restricts egress from the intermediate region by cooperating with the first and second portions when they are in the mounted position.

20 Claims, 3 Drawing Sheets

WALL HANGER

BACKGROUND OF THE INVENTION

1. Field of the Invention

The invention relates generally to a wall hanger, and more specifically, to a wall hanger that affirmatively connects with an object to secure the object to a surface, even when the surface is unstable or prone to movement.

2. Description of the Prior Art

Traditional wall hangers usually depend upon gravity and relatively stable conditions to secure an object to a surface. For example, the most common wall hanger—the quintessential nail in the wall—adequately suspends a wire mounted picture when properly anchored to a stable wall. However, when the wall experiences vibration such as in a home located near an earthquake fault or in a boat or train, the nail's frictional hold on the wire is woefully inadequate. A more positive connection to the picture is required. In the past, pictures have been permanently affixed to the walls using nails, screws, adhesives, and the like. Such fasteners, however, often mar the picture or its frame and prevent its easy removal.

Other prior art devices rely upon the shape of the hanger, with or without a nail or screw, to adequately secure an object to a wall. For example, U.S. Pat. No. 3,517,903 to Gutshall, incorporated herein by reference, discloses a hanger assembly comprising a bracket which is fastened to the surface with screw extending through an aperture. This bracket is particularly useful for holding electrical outlet boxes, conduits and the like. U.S. Pat. No. 3,729,159 to Foster, which is incorporated herein by reference, also teaches a hanger assembly comprising a curved bracket which is fastened to the surface with a screw extending through an aperture. This bracket is especially useful as plywood to concrete wall forms. The curved bracket is difficult it bend and protects against tilting of the wall form. U.S. Pat. No. 5,000,409 to MacLeod et al, which is herein incorporated by reference, shows a hanger assembly comprising a notched bracket which is fastened to the surface by sliding the notches around the edges of the surface. The surface is the siding on the wall of a building and the bracket is particularly made to slide over the siding and hold a lighting fixture, pipe or vent on the wall. None of .these prior art devices, however, protect against a surface which is unstable or prone to movement.

Therefore, a need exists for a wall hanger that affirmatively secures an object to a wall which is prone to movement without penetrating or otherwise marring it with fasteners or glues. The present invention fulfills this need.

SUMMARY OF THE PRESENT INVENTION

The present invention provides a wall hanger for safely and easily securing an object having a suspension element to a surface. In its basic embodiment, the wall hanger comprises a first and second portion which may be separate or integral and restrictive means. The first portion has opposing first and second sides, a top and bottom, and a first bore substantially normal to the sides and adapted to receive the shaft of a fastener. About the first bore on the second side is an annular seating region to accommodate the head of the fastener such that the head of the fastener presses against the seating region when the first portion is in a mounted position. The second portion has opposing third and fourth sides, a top and bottom, and a second bore larger than the head of the fastener such that the fastener passes through it. The first and second portions are contiguous at the bottom when in the mounted position such that the second side faces the third side to define an intermediate region. The intermediate region is adapted to accommodate the suspension element of the object. When in the mounted position, the first and second bores align such that the second bore provides access to the first bore. The restrictive means restricts the egress of the suspension element from the intermediate region by cooperating with the first and second portions when they are in the mounted position.

The following objects, features and advantages are met by one or more embodiments of the present invention:

It is an object of the invention to provide restrictive means for affirmatively connecting the object's suspension element to the wall hanger.

It is a further object of the invention to provide an access bore for mounting the wall hanger.

It is a feature of the invention that an object's suspension element is restricted from disengaging from the wall hanger.

It is an additional feature of the invention that it essentially connects to an object without penetrating or otherwise marring it.

It is an advantage of the present invention that it secures an object to a surface even where the surface is unstable and prone to movement.

It is a further advantage of the present invention that it installs easily and is hidden by the object it supports.

These and other objects, features and advantages of the invention will be apparent to those skilled in the art upon consideration of the following drawings and description of the preferred embodiments.

DETAILED DESCRIPTION OF THE PRESENT INVENTION

Figure 1:
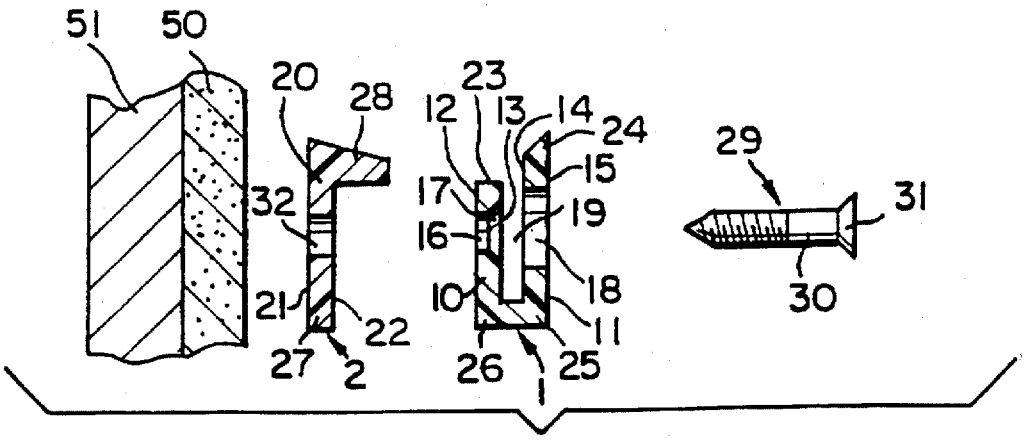
FIG. 1 shows an exploded profile view of a two piece embodiment of the present invention.

The invention may best be understood by reference to the following description taken in conjunction with the accompanying drawings, wherein like reference numerals identify like elements.

The present invention is directed to a wall hanger for securing an object having a suspension element to a surface. In its basic embodiment, the wall hanger comprises a first and second portion which may be integral or separate and restrictive means. Preferably, the portions are composed of a tough, rigid material to endure the stress of the object's inertia and gravitational force. Suitable materials include high modulus plastics, polyvinyl chloride, hard rubber, nylon, metals and the like. The first portion has opposing first and second sides, a top and bottom, and a first bore substantially normal to the sides and adapted to receive the shaft of a fastener. Suitable fasteners have a shaft and a head, and include screws, rivets, nails and the like. About the first bore on the second side is an annular seating region to accommodate the head of the fastener such that the head of the fastener presses against the seating region when the first portion is in a mounted position. The second portion has opposing third and fourth sides, a top and bottom, and a second bore larger than the head of the fastener such that the fastener passes through it. In applications where nails or rivets are used as fasteners, it is preferred that the second bore have a diameter sufficient to accommodate the head of a fastener. The first and second portions are contiguous at the bottom in the mounted position such that the second side faces the third side to define an intermediate region. The intermediate region is adapted to accommodate the suspension element of the object. When in the mounted position, the first and second bores align such that the second bore provides access to the first bore. The restrictive means restricts egress from the intermediate region by cooperating with the first and second portions when they are in the mounted position.

Figure 2:
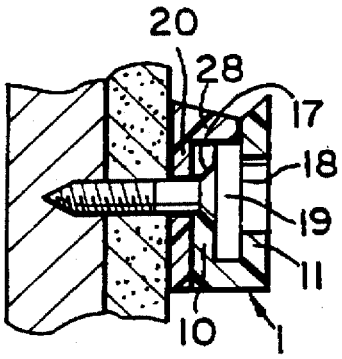
FIG. 2 shows a side view of the embodiment of FIG. 1 in a mounted position.
Figure 3:
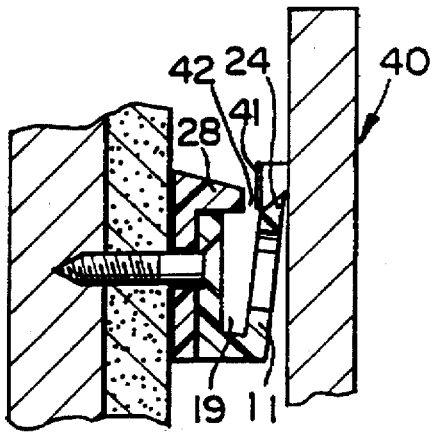
FIG. 3 shows a side view of the embodiment of FIG. 1 in the process of having a picture with a bracket secured to it.

The term "object" in this disclosure broadly refers to any object having a suspension element by which the object is intended to be suspended, affixed, or otherwise hung on a surface. Such objects include household items like pictures, plaques, mirrors, plates, cabinets, and even a clothes line, as well as structural items like wiring and plumbing. The suspension element may be any traditional bracket, string, wire, hook, loop, harness, recess or slot or the like that is used to suspend an object to a surface. Again, the term "surface" is used broadly in this context, and includes walls and ceilings in houses, mobile homes, trains, airplanes, and boats. In fact, due to the restrictive means essentially connecting the object to the wall hanger, the device is particularly well suited for applications where the supporting surface is unsteady or prone to movement, such as in boats, land and vehicles or in earthquakes prone areas Referring now to FIGS. 1–5, a two piece embodiment of the present invention is shown. The exploded view in FIG. 1 shows a hanger 1 comprising the first and second portions 10, 11. The first portion 10 has opposing first and second sides 12, 13, and a top and bottom 23, 26. Additionally, the first portion 10 has a first bore 16 substantially normal to the Sides which is adapted to receive the shaft 30 of a fastener 29. About the first bore 16 on the second side is an annular seating region 17 to accommodate the head 31 of the fastener 30 such that the head 31 of the fastener 30 presses against the seating region 13 when the first portion 10 is in a mounted position, as shown in FIGS. 2–5. The second portion 11 has opposing third and fourth sides 14, 15 and a top 24 and bottom 25. The first and second portions 10, 11 are contiguous at the bottom such that the second side 13 faces the third side 14 to define an intermediate region 19. In this embodiment the first and second portions 11, 12 are integral to the first piece 1, although embodiments in which each portion is discrete are possible. Additionally, the second portion has a second bore 18 larger than the head 31 of the fastener 30 such that the fastener 30 passes through the second bore 18. When in the mounted position (FIGS. 2–5), the first and second bores 16, 18 align such that the second bore 18 provides access to the first bore 16. As shown in FIG. 3, the intermediate region 19 is adapted to accommodate a suspension element 41 of the object 40. The suspension element 41 is restricted from escaping the intermediate region 19 by the restriction means.

The restrictive means in this embodiment employs a second piece 2. The second piece comprises a third portion 20 having fifth and sixth opposing sides 21, 22, a third bore 32 substantially normal to the fifth and sixth sides 21, 22, and an upper tab 28 extending substantially normal to the fifth and sixth sides 21, 22. The sixth side 22 interfaces with the first side 12 such that the first and third bores 16, 32 align. Moreover, the fifth side 21 is adapted to interface with the wall 50 when the portions are in the mounted position. The upper tab 28 is contiguous with the tops 23, 24 of the first and second portions 10, 11 when the portions are in the mounted position as shown in FIG. 2. Therefore, the upper tab 28 serves to envelop the intermediate region 19 and restrict egress from the region.

Figure 4:
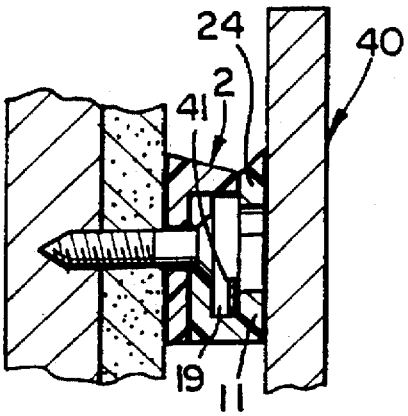
FIG. 4 shows a side view of the embodiment of FIG. 1 with the picture in the secured position.

To introduce the suspension element to the intermediate region 19, the second member 11 is designed to be flexible. As shown in FIG. 3, a gap 42 is formed at the top 24 of the second portion 11 and the upper tab 28 when the second portion 11 is flexed. This allows the suspension element 41 to be slipped into the intermediate region 19. When the second portion is relaxed, it returns to its original position and closes the gap as shown in FIG. 4. The suspension element 41 is therefore restricted from leaving the intermediate region 19.

Figure 5:
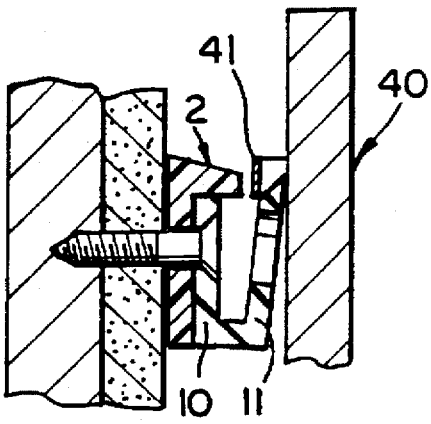
FIG. 5 shows a side view of the embodiment of FIG. 1 with the picture in the process of being removed.

Functionally, the wall hanger in this embodiment is first secured to the wall 50 by a fastener 30. Since it is anticipated that the present invention will be used to support potentially heavy objects in unstable conditions (e.g., earthquake areas or vehicles), it is preferable that a screw is used as the fastener, and that it is anchored in a stud 51 behind the wall 50. The screw is inserted completely through the second bore 18 such that its head 31 makes intimate contact with the seating region 17, and its shaft 29 passes through the first and third bores 16 and 32. The second bore 18 provides access for a screwdriver to tighten the screw. Once secured as shown in FIG. 2, an object may be secured to it. To this end, the first portion is flexed to expose a gap 42 between the upper tab 28 and the top 24 of the first portion 11. The intermediate region 19 is adapted to receive the suspension element 41 which in this case is a bracket. It should be understood, however, that any traditional suspension element such as a wire, hook, recess, or slot will work as well. The second portion 11 is inserted in the bracket, and then released to return to its relaxed position wherein the gap 42 closes. The picture is now essentially connected to the wall hanger, and the wall hanger is securely fastened to the wall. To remove the picture, the process is reversed such that the picture 40 slides off the second portion 11 as shown in FIG. 5.

Figure 6:
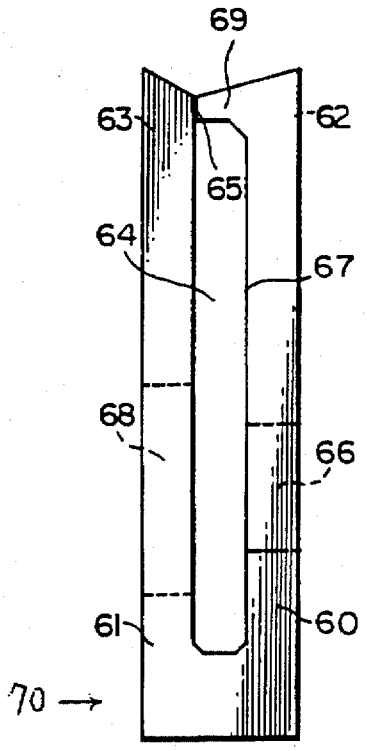
FIG. 6 shows a side view of a single piece embodiment of the present invention.
Figure 7:
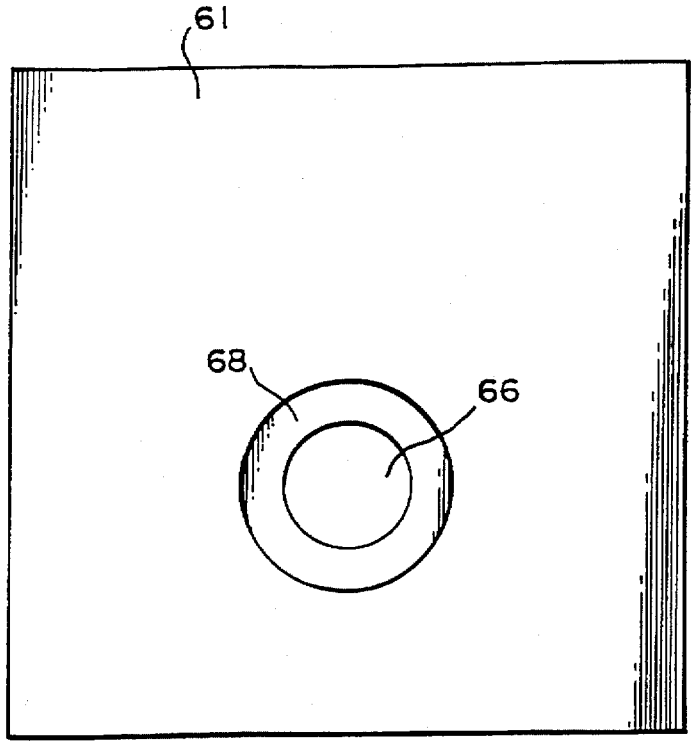
FIG. 7 shows a front view of the embodiment of FIG. 6.
Figure 9:
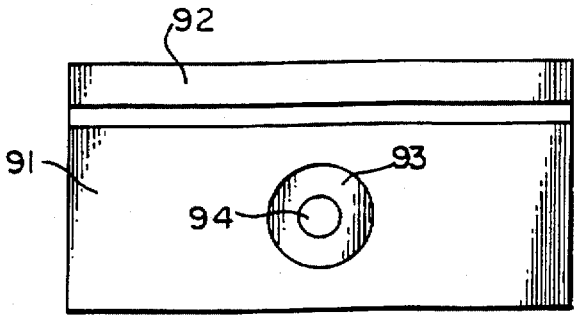
FIG. 9 shows a front view of the embodiment of FIG. 8.
Figure 8:
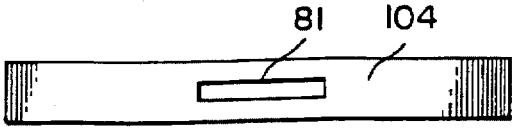
FIG. 8 shows a top view of a variation of the single piece embodiment of the present invention wherein the second portion is releasibly engaged with the first portion.

Another embodiment of the invention is shown in FIGS. 6–7 wherein a wall hanger 70 comprises an integral and flexible first and second portion 60, 61 having a first and second bore 66, 68, respectively. The restrictive means in this embodiment, however, comprises an upper extension 69 extending substantially normally from the top 62 of the first portion 60 toward the second portion 61 such that it is contiguous with the top 63 of the second portion 61. In this manner, the egress from the intermediate region 64 is restricted. To introduce a suspension element such as the wire of a picture frame to the intermediate region 64, the second member 61 is designed to be flexible. Similar to the embodiment shown in FIG. 3, the second portion 61 is flexed to create a gap at the interface 65 of the upper extension 69 and the top 63 of the second portion 61. This allows a suspension element to be slipped into the intermediate region 64. When the second portion is relaxed, it returns to its original position and closes the interface 65 to restrict egress from the intermediate region 64. Although the upper extension is shown extending from the first portion 60 in FIG. 6, it should be understood that other embodiments are possible, such as a similar upper extension that extends from the second portion rather than the first portion. Functionally, this embodiment is very similar to that of FIGS. 1–5, except the initial mounting of the device to the wall is simpler because it comprises only one piece.

Figure 13:
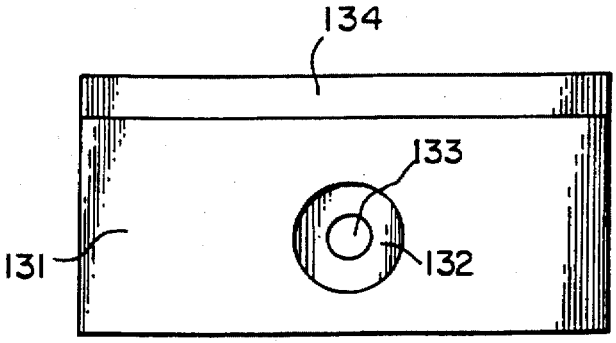
FIG. 13 shows a front view of a single piece embodiment having a labyrinth as restricting means.
Figure 14:
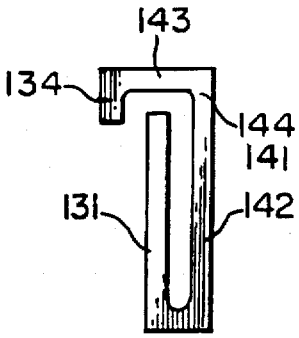
FIG. 14 shows a side view of the embodiment of FIG. 13.
Figure 15:
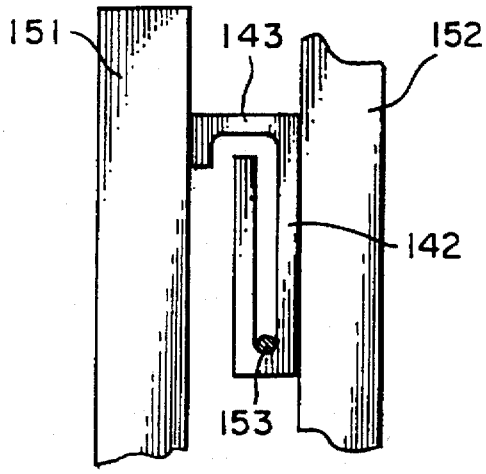
FIG. 15 shows a side view of the embodiment of FIG. 13 with a picture having a wire attachment in the secured position.

In another embodiment of the present invention, the restrictive means comprises a labyrinth as shown in FIGS. 13–15. This embodiment comprises the basic elements—namely the first and second portions 142, 131 with first and second bores 133, 132 respectively—as well as an upper extension 143. The upper extension 143 extends substantially normally from the top 144 of the first portion 142 beyond the second portion 131. At this point, a distal end 134 turns down from the upper extension 143. This extension forms a labyrinth with the second portion to restrict egress from the intermediate region 141. As shown in FIG. 15, this embodiment is particularly well suited for an hanging object 151 having wire 153 as a suspension element. The wire can easily negotiate the labyrinth to lie in the intermediate region 153. It should be understood, however, that this is only one embodiment of a labyrinth, and others will be apparent to someone skilled in the art. Other suitable labyrinths include a similar extension originating from the second portion, or ridged or corrugated first and second portions that form a labyrinth within the intermediate region 142.

In yet another embodiment, the restrictive means may have releasibly engaging means as shown in FIGS. 9–12. The device has the same basic elements of the previous embodiments, i.e., first and second portions 102, 91 having first and second bores 94, 93 respectively. The means of releasibly engaging serve to engage the portions near their tops such that egress from the intermediate region is restricted. Flexibility in the second portion allows a gap to form between the tops of the portions when the second portion is disengaged and flexed. One embodiment of this is similar to the embodiment of FIGS. 6–7; an upper extension 104 extends substantially normally from the top 103 of the first portion 102 toward the second portion 91 such that it is contiguous with the top of the second portion 101. The second portion 91 is flexible allowing it to be flexed to form a gap 111 (see FIG. 11) between the top 101 of the second portion 91 and the upper extension 104. Like the previous embodiments too, this configuration is subject to modification without departing from the spirit of the invention; e.g., the extension may originate from the second portion. This embodiment differs from the others, however, since the upper extension actually engages the second portion.

Figure 10:
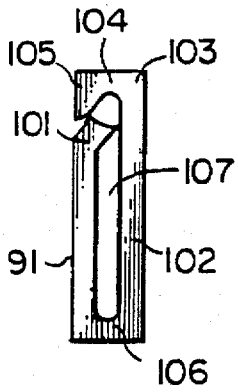
FIG. 10 shows a side view of the embodiment of FIG. 8 with the second portion engaged in the first.
Figure 11:
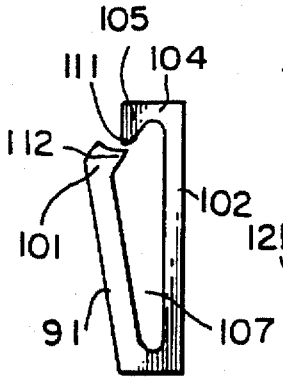
FIG. 11 shows a side view of the embodiment of FIG. 8 with the second portion disengaged from the first.
Figure 12:
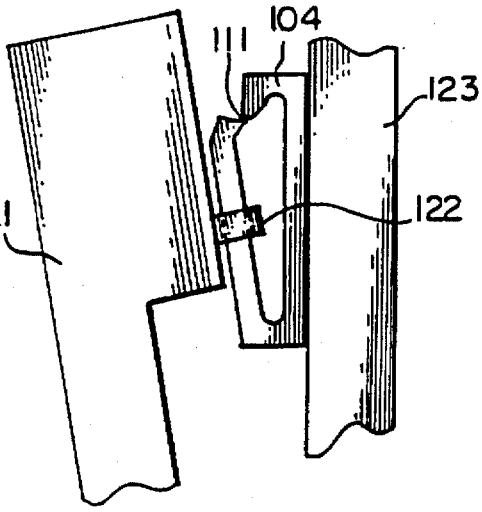
FIG. 12 shows a side view of the embodiment of FIG. 8 with the second portion disengaged from the first and in the process of having a picture with a bracket secured to it.

The means of releasibly engaging may assume various embodiments. As shown in FIG. 10, the means of releasibly engaging include a small downward tab 105 on the upper extension 104 adapted to contact the top 101 of the second portion 91. Flexibility in either the upper extension 104 or the second portion 91 or both, allows the top 101 to slip past the downward tab 105 when suitable force is applied to the second portion. Either the geometry, the rigidity, or both of the downward tab 105 and second portion 91 serve to hold the device in an engaged position. In the engaged position (shown in FIG. 10), egress from the intermediate region is severely restricted. Other means of releasibly engaging the tops of the portions will be obvious to someone skilled in the art.

To release the second member and provide access to the intermediate region 107, outward force may be applied to the second member 91. Alternatively, a slot 81 may be added to the upper extension 104 to provide access for a screwdriver. Functionally, the user would insert the head of a straight slot screw driver into slot 81. Due to the length of the screwdriver's shaft, the user can easily apply increased force to the top 101 to release it from the upper extension 104. The user may also want to use the screw driver to aid in engaging the second portion 91. That is, the user may insert the screwdriver in the slot 81 and "reach" outwardly with its head to grab the top 101. Again, the lever action of the screwdriver then enables the user to effortlessly snap the second portion in place. To aid in this process, a small ridge 112 may be deposed at the top's edge facing the intermediate region 107. The ridge 112 provides a purchase point for the screwdriver.

Obviously, numerous modifications and variations of the present invention are possible in the light of the above teachings. It is therefore understood that within the scope of the appended claims, the invention may be practiced otherwise than as specifically described herein.

What is claimed is:

1. A wall hanger for securing an object having a suspension element to a surface, said hanger comprising a first portion, a second portion and restrictive means;

said first portion including opposing first and second sides, a top, a bottom, and a first bore substantially normal to said sides, said first bore adapted to receive a shaft of a fastener, said second side having an annular seating region about said first bore to accommodate a head of said fastener such that said head of said fastener presses against said seating region when said first portion is in a mounted position;

said second portion including opposing third and fourth sides, a top and bottom, said bottom of said second portion contiguous with said bottom of said first portion such that said second side faces said third side to define an intermediate region, said second portion having a second bore larger than said head of said fastener such that said fastener passes through said second bore, said first and second bores aligning when said first and second portions are in said mounted position such that said second bore provides access to said first bore, said intermediate region being adapted to accommodate said suspension element of said object; and said restrictive means being adapted for restricting egress from said intermediate region by cooperating with said first and second portions when said portions are in said mounted position.

2. The device of claim 1, wherein said restrictive means comprises a third portion having fifth and sixth opposing sides, a third bore substantially normal to said fifth and sixth sides, and an upper tab extending substantially normal to said fifth and sixth sides, said sixth side interfacing with said first side such that said first and third bores align when said portions are in said mounted position, said fifth side being adapted to interface with said wall, said upper tab being contiguous with the tops of said first and second portions when said portions are in said mounted position.

3. The device of claim 2, wherein said restrictive means further comprises flexibility in said second portion such that a gap forms between said top of said second portion and said upper tab when said second portion is flexed, and wherein said second portion is contiguous with said upper tab when said second portion is relaxed.

4. The device of claim 3, wherein said second portion is adapted to receive a wire suspension element.

5. The device of claim 1, wherein said restrictive means comprises a labyrinth.

6. The device of claim 5, wherein said labyrinth is formed by upper extension extending substantially normally from said top of said first portion beyond said second portion and turning downward to extend beyond said top of said second portion.

7. The device of claim 6, wherein said second portion is adapted to receive a wire suspension element.

8. The device of claim 1, wherein said restrictive means provide substantial proximity between said portions near their tops such that egress from said intermediate region is restricted, and flexibility in said second portion such that a gap forms between said tops of said first and second portions when said second portion is flexed, said gap being substantially narrowed when said second portion is relaxed.

9. The device of claim 1, wherein said restrictive means comprises an upper extension extending substantially normally from said top of said first portion toward said second portion such that it is contiguous with said top of said second portion, and wherein said restrictive means further provide flexibility in said second portion such that a gap forms between said top of said second portion and said upper extension when said second portion is flexed, said gap being substantially narrowed when said second portion is relaxed.

10. The device of claim 9, wherein said second portion is adapted to receive a wire suspension element.

11. The device of claim 1, wherein said restrictive means includes means for releasibly engaging said portions near their tops such that egress from said intermediate region is restricted, and flexibility in said second portion such that a gap forms between said tops of said first and second portions when said second portion is disengaged and flexed.

12. The device of claim 1, wherein said restrictive means includes an upper extension extending substantially normally from said top of said first portion toward said second portion such that it is contiguous with said top of said second portion, flexibility in said second portion allowing it to be flexed to form a gap between said second portion and said upper tab, and means for releasibly engaging said upper extension and said second portion.

13. The device of claim 12, wherein said engaging means include a small downward tab on said upper extension which is adapted to allow said top of said second portion to slip past when suitable force is applied to said second portion.

14. The device of claim 13, wherein said second portion is adapted to receive a support bracket.

15. The device of claim 12, wherein said upper extension has a slot substantially parallel to said first portion to provide access for a head of a screwdriver for purposes of releasing said second portion from said engaging means.

16. A wall hanger for securing an object to a surface, said hanger comprising:

a first portion including opposing first and second sides, a top, a bottom, and a first bore substantially normal to said sides, said first bore adapted to receive a shaft of a fastener, said second side having an annular seating region about said first bore to accommodate a head of said fastener such that said head of said fastener presses against said seating region when said first portion is in a mounted position;

said second portion including opposing third and fourth sides, a top and bottom, said bottom of said second portion contiguous with said bottom of said first portion such that said second side faces said third side to define an intermediate region, said second portion having a second bore larger than said head of said fastener such that said fastener passes through said second bore, said first and second bores aligning when said first and second portions are in said mounted position such that said second bore provides access to said first bore, said intermediate region being adapted to accommodate a suspension element of said object; and restrictive means for restricting egress from said intermediate region by cooperating with said first and second portions when said portions are in said mounted position; and a fastening means for securing said portions to said surface.

17. The device of claim 16, wherein said restrictive means provide substantial proximity between said portions near their tops such that egress from said intermediate region is restricted, and flexibility in said second portion such that a gap forms between said tops of said first and second portions when said second portion is flexed, said gap being substantially narrowed when said second portion is relaxed.

18. The device of claim 16, wherein said fastening means includes a fastener having a head and a shaft.

19. The device of claim 18, wherein said fastening means comprises a fastener selected from the group consisting of a screw and a nail.

20. The device of claim 19, wherein said second bore is large enough to accommodate the head of a fastener.

* * * * *